US011512718B2

(12) United States Patent
Espersen et al.

(10) Patent No.: US 11,512,718 B2
(45) Date of Patent: Nov. 29, 2022

(54) HYDRAULIC PRESSURE AMPLIFIER ARRANGEMENT

(71) Applicant: miniBOOSTER Hydraulics A/S, Sønderborg (DK)

(72) Inventors: Christen Espersen, Augustenborg (DK); Peter Leonhard Wasmer, Kruså (DK); Thyge Bollmann, Augustenborg (DK); Peter J. Mads Clausen, Nordborg (DK); Jan Petersen, Egernsund (DK); Leif Hansen, Sønderborg (DK); Jimmy Thomsen, Nordborg (DK); Andreas Wollesen, Gråsten (DK)

(73) Assignee: miniBOOSTER Hydraulics A/S, Sønderborg (DK)

( * ) Notice: Subject to any disclaimer, the term of this patent is extended or adjusted under 35 U.S.C. 154(b) by 126 days.

(21) Appl. No.: 17/161,809

(22) Filed: Jan. 29, 2021

(65) Prior Publication Data

US 2021/0239138 A1 Aug. 5, 2021

(30) Foreign Application Priority Data

Jan. 31, 2020 (EP) ..... 20154833

(51) Int. Cl.
*F15B 3/00* (2006.01)
*F15B 13/02* (2006.01)

(52) U.S. Cl.
CPC ..... *F15B 13/021* (2013.01); *F15B 3/00* (2013.01); *F15B 2211/214* (2013.01)

(58) Field of Classification Search
CPC ..... F15B 3/00; F15B 11/032
See application file for complete search history.

(56) References Cited

U.S. PATENT DOCUMENTS

| | | | | |
|---|---|---|---|---|
| 5,971,027 | A * | 10/1999 | Beachley | F15B 1/02 138/30 |
| 7,726,950 | B2 | 6/2010 | Hansen et al. | |
| 10,337,535 | B2 * | 7/2019 | Buhl | F15B 11/032 |
| 2008/0008601 | A1 * | 1/2008 | Chausen | F15B 3/00 417/226 |

(Continued)

FOREIGN PATENT DOCUMENTS

| | | | |
|---|---|---|---|
| DE | 19633258 | C1 | 8/1997 |
| DE | 103 61 619 | A1 | 7/2005 |

(Continued)

*Primary Examiner* — Michael Leslie
*Assistant Examiner* — Matthew Wiblin
(74) *Attorney, Agent, or Firm* — McCormick, Paulding & Huber PLLC

(57) ABSTRACT

A hydraulic pressure amplifier arrangement (1) comprising a supply port (IN), a return port (R), a high pressure port (H1), and a pressure amplifier unit (2) having a low pressure inlet (3) connected to the supply port (IN) and a high pressure outlet (4) connected to the high pressure port (H1) is described, wherein the pressure amplifier unit (2) comprises an amplification factor. In such a hydraulic pressure amplifier arrangement it should be possible to allow simply releasing off pressure at the high pressure port while keeping small unnecessary energy consumption. To this end a control valve (8) is arranged in a connection between the high pressure port (H1) and the return port (R).

16 Claims, 4 Drawing Sheets

(56) References Cited

U.S. PATENT DOCUMENTS

| | | | | |
|---|---|---|---|---|
| 2016/0090999 | A1* | 3/2016 | Jorgensen | F15B 13/02<br>60/591 |

FOREIGN PATENT DOCUMENTS

| | | | |
|---|---|---|---|
| DE | 10249523 | B4 | 7/2006 |
| DE | 102009035278 | B4 | 11/2013 |
| JP | 2001-289154 | A | 10/2001 |

* cited by examiner

HYDRAULIC PRESSURE AMPLIFIER ARRANGEMENT

CROSS-REFERENCE TO RELATED APPLICATION

This application claims foreign priority benefits under 35 U.S.C. § 119 to European Patent Application No. 20154833.6 filed on Jan. 31, 2020, the content of which is hereby incorporated by reference in its entirety.

TECHNICAL FIELD

The present invention relates to a hydraulic pressure amplifier arrangement comprising a supply port, a return port, a high pressure port, and a pressure amplifier unit having a low pressure inlet connected to the supply port and a high pressure outlet connected to the high pressure port, wherein the pressure amplifier unit comprises an amplification factor.

BACKGROUND

Such a hydraulic pressure amplifier arrangement is known, for example, from DE 102 49 523 B4. The pressure amplifier unit comprises a differential piston having a low pressure piston movable in a low pressure cylinder and a high pressure piston movable in a high pressure cylinder. The low pressure piston and the high pressure piston are movable together. The amplification factor corresponds to the ratio of the pressure area of the low pressure piston to the pressure area of the high pressure piston.

Such a hydraulic pressure amplifier arrangement is used to deliver hydraulic fluid to a consumer with a pressure which is larger than the pressure supplied to the hydraulic pressure amplifier arrangement. In this way a pressure source delivering the hydraulic fluid under the lower pressure can be kept small, while the consumer can be supplied with a higher pressure. One field of application of such a hydraulic pressure amplifier arrangement is a clamping arrangement in a machine tool which is hydraulically operated. Using the hydraulic pressure amplifier arrangement allows to produce high clamping forces without the need to have a pressure source producing high pressures.

However, when the high pressure has been supplied to the high pressure port, it is in some cases necessary to lower the pressure at the high pressure port, for example to untighten the clamping means.

SUMMARY

The object underlying the invention is to allow the pressure to be released simply and keeping small the risk of unnecessary energy consumption.

This object is solved with a hydraulic pressure amplifier arrangement as described at the outset in that a control valve is arranged in a connection between the high pressure port and the return port.

The control valve can be used to establish a short circuit between the high pressure port and the return port which is a simple way to release the pressure at the high pressure port.

In an embodiment of the invention the control valve is controlled by a pressure difference between the high pressure port and the supply port. In other words, the control valve is hydraulically operated. The forces to actuate the control valve are already available in the arrangement, so that additional auxiliary energies are not necessary.

In an embodiment of the invention the control valve comprises a first control pressure area connected to the supply port and a second control pressure area connected to the high pressure port, wherein a pressure acting on the first pressure area loads the control valve in a closing direction and a pressure acting on the second pressure area loads the control valve in an opening direction, wherein a ratio between the first control pressure area and the second control pressure area is larger than the amplification factor. When the ratio is larger than the amplification factor, a force produced by the pressure at the supply port is always larger than a corresponding pressure produced by the pressure at the high pressure port. Thus, the control valve is kept in the closing condition, so that no short circuit can be established during normal operation. However, when the pressure at the supply port is reduced, the control valve automatically opens and establishes the short-circuit (or any other connection) between the high pressure port and the supply port. This means, that the control valve is fail safe. When the pressure source is turned off, the control valve will automatically switch or be moved in the open condition.

In an embodiment of the invention the control valve comprises a check valve interrupting in the closed condition of the control valve the connection between the high pressure port and the return port. Thus, the control valve blocks a connection between the high pressure port and the return port only in one direction. If for any reasons the pressure at the return port is higher than the pressure at the high pressure port, the risk that the amplifier arrangement is damaged, is kept small.

In an embodiment of the invention a second control valve is arranged between the supply port and the pressure amplifier unit, wherein the second control valve is operable to interrupt the connection between the supply port and the pressure amplifier unit. A control valve corresponding to the second control valve is known, for example, from DE 10 2009 035 278 B4. The second control valve is used to disconnect or prevent pump pressure, i.e. pressure at the supply port, from reaching the pressure amplifier unit when the desired pressure is reached at the high pressure port. Thus, the second control valve helps to prevent leakage in the amplifier arrangement. When the pressure at the high pressure port decreases, the second control valve will open automatically and hydraulic fluid will flow to the pressure amplifier unit which will deliver pressure again until the desired pressure is reached at the high pressure port and then the second control valve will close again.

In an embodiment of the invention the second control valve is controlled by a difference between a pressure at the return port acting on a first control port of the second control valve and a pressure in the line from the high pressure outlet to the high pressure port acting on a second control port of the second control valve, wherein the second control port is separated from the second pressure control area by means of a first check valve opening in a direction towards the second pressure control area. The second control valve is likewise hydraulically operated. However, the operation of the first control valve and of the second control valve are decoupled by means of the first check valve.

In an embodiment of the invention the first check valve is arranged between the high pressure outlet and the high pressure port. The first check valve is in addition used to trap hydraulic fluid under the higher pressure at the high pressure port, i.e. once the high pressure is reached at the high pressure port in connection to a hydraulic consumer it cannot leak thus avoiding unnecessary energy consumption.

A decrease of the pressure at the high pressure port can be achieved only by operating the first control valve.

In an embodiment of the invention a second check valve is arranged between the high pressure outlet and the high pressure port upstream a connection to the second control port. Thus, there are two check valves arranged in series between the high pressure outlet of the pressure amplifier unit and the high pressure port. However, the pressure to operate the second control valve is taken from a point between these two check valves.

In an embodiment of the invention the pressure amplifier unit, the first control valve, the second control valve, the first check valve, and the second check valve are arranged in a common housing. This makes the construction of the pressure amplifier arrangement simple. All connections necessary can be formed by channels within the housing.

In an embodiment of the invention the housing comprises a number of housing blocks in form of a stack. Assembling of the housing can simply be performed by stacking the housing blocks and by connecting them, for example using bolts or screws. The number can be, for example, four or six.

In an embodiment of the invention the first control valve and/or the second control valve are bridging an interface between two adjacent housing blocks. In other words, a first part of a control valve can be arranged in one housing block and another part of the control valve can be arranged in an adjacent housing block. Such a construction can be chosen for the first control valve or the second control valve or for the first control valve and the second control valve. Such an arrangement is in particular of advantage when the pressure areas or pressure ports of the control valve have different sizes, as explained before in connection with the first control valve.

In an embodiment of the invention the pressure amplifier unit comprises a low pressure piston arranged in one housing block and a high pressure piston arranged in an adjacent housing block. Thus, the piston arrangement of the pressure amplifier unit is likewise bridging an interface between two adjacent housing blocks. Thus, one housing block can be provided with the low pressure cylinder and the other housing block can be provided with the high pressure cylinder. This makes the construction simple.

In an embodiment of the invention the first check valve and the second check valve are separated by a housing block which accommodates part of the second control valve. Thus, the two check valves do not disturb each other. However, the space between the two check valves can be used for accommodating at least part of the second control valve.

In an embodiment of the invention the first control valve comprises a first control valve element and the second control valve comprises a second control valve element, wherein movable parts of the pressure amplifier unit have the same direction of movement as the first control valve element and the second control valve element. Movable parts of the pressure amplifier are, for example, the low pressure piston and the high pressure piston. Using the same direction of movement for most or even all parts of the pressure amplifier arrangement keeps small the dimensions of the pressure amplifier arrangement in a direction perpendicular to the moving direction.

BRIEF DESCRIPTION OF THE DRAWINGS

Preferred embodiments of the invention will now be described in more detail with reference to the drawings, wherein.

DETAILED DESCRIPTION

The same elements are denoted with the same reference signs in all figures.

Figure 1:
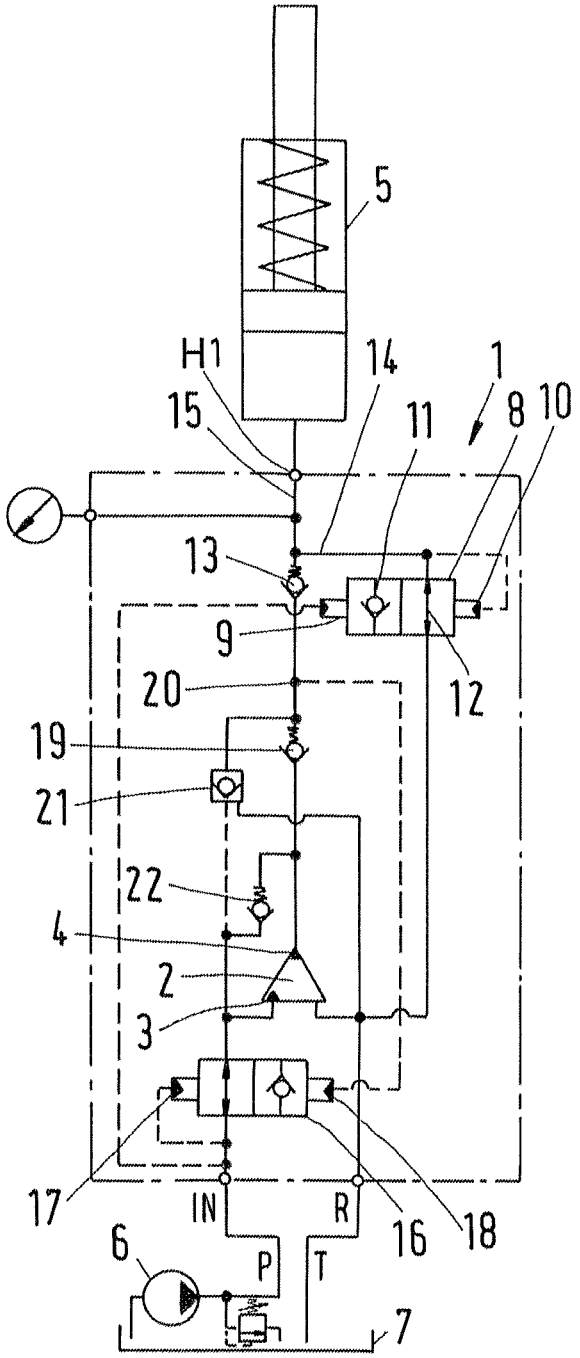
FIG. 1 shows a first embodiment of a hydraulic pressure amplifier arrangement.

FIG. 1 schematically shows a pressure amplifier arrangement comprising a supply port IN, a return port R, a high pressure port H1 and a pressure amplifier unit 2 having a low pressure inlet 3 connected to the supply port IN and a high pressure outlet 4 connected to the high pressure port H1, wherein the pressure amplifier unit 2 comprises an amplification factor.

The pressure amplifier unit is described, for example, in DE 196 33 258 C1 or DE 102 49 523 B4. It comprises a differential piston having a low pressure piston movable in a low pressure cylinder and a high pressure piston movable in a high pressure cylinder. The low pressure piston and the high pressure piston are movable together at least in an amplification stroke. The amplifier has an amplification factor which corresponds to the ratio between a pressure area of the low pressure piston and a pressure area of the high pressure piston. A switching valve is provided to control the movement of the amplifier piston and to connect the low pressure cylinder to the supply port IN or to the return port R depending on the moving direction of the amplifier piston.

A hydraulic consumer 5 can be connected to the high pressure port H1. The supply port IN can be connected to a pump 6 and the return port R can be connected to a tank 7. A further port H2 can be provided which is connected in parallel to the high pressure port H1. This port H2 can be used to connect a pressure gauge.

A first control valve 8 is arranged between the high pressure port H1 and the return port R. The first control valve 8 is hydraulically operated. It comprises a first control pressure area 9 connected to the supply port IN and a second control pressure area 10 connected to the high pressure port H1, wherein a pressure acting on the first control pressure area 9 loads the first control valve 8 in a closing direction and a pressure acting on the second pressure area 10 loads the first control valve 8 in an opening direction. A ratio between the first control pressure area 9 and the second control pressure area 10 is larger than the amplification factor. This means, that as long as a positive pressure is available at the supply port IN, the first control valve 8 is shifted and held in the closing position. Only in case the pressure at the supply port IN disappears, the first control valve 8 is moved to the opening position shown in FIG. 1.

The first control valve 8 comprises a check valve 11. In the closed position of the control valve 8 the check valve 11 blocks a flow from the high pressure port H1 to the return port R, but would allow a flow of hydraulic fluid from the return port R to the high pressure port H1. In the open position shown in FIG. 1, the first control valve 8 establishes a through-going flow path 12 from the high pressure port H1 to the return port R.

This arrangement is failsafe. When the pressure at the supply port IN disappears, for example when the pump 6 stops operation, there is no hydraulic fluid having a pressure which is to be amplified. Thus, the pressure at the first control pressure area 9 disappears and the pressure at the high pressure port H1 shifts the first control valve 8 into the opening position so that the pressure at the high pressure port H1 is immediately released.

A first check valve 13 is arranged between the high pressure outlet 4 and the high pressure port H1. A line 14 to the second control pressure area 10 and to the input of the first control valve 8 on the high pressure side branches off a connection 15 between the high pressure outlet 4 and the high pressure port H1 downstream the first check valve 13. Thus, as long as the first control valve 8 is closed, pressure at the high pressure port H1 is trapped and leakage is avoided.

The hydraulic pressure amplifier arrangement 1 comprises a second control valve 16 which is arranged between the supply port IN and a low pressure inlet 3 of the pressure amplifier unit 2. The second control valve 16 is likewise hydraulically operated. It is controlled by a difference between a pressure at the supply port IN acting on a first control port 17 of the second control valve 16 and a pressure in a connection 15 from the high pressure outlet 4 to the high pressure port H1 acting on a second control port 18 of the second control valve 16. The second control port 18 is separated from the second pressure control area 10 by means of the first check valve 13.

A second check valve 19 is arranged between the high pressure outlet 4 and the first control valve 13. The second control port 18 of the second control valve 16 is connected to a point 20 between the two check valves 13, 19.

The same point 20 is connected to the low pressure inlet 3 of the pressure amplifier unit 2 by means of a dump valve 21 open in a direction away from the low pressure inlet 3 of the pressure amplifier unit 2. The dump valve 21 can be hydraulically opened when a pressure is applied to the return port R in order to release the high pressure outlet 4 of the pressure amplifier unit 2.

A third check valve 22 is arranged between the second control valve 18 and the high pressure outlet 4 of the pressure amplifier unit 2. The third check valve 22 is used to fill the high pressure cylinder of the pressure amplifier unit 2.

The second control valve 18 is used to disconnect or prevent pump pressure or inlet pressure at the supply port IN from reaching the pressure amplifier unit 2 when the desired pressure is reached at the high pressure port H1 thus preventing leakage in the arrangement. When the pressure at the high pressure port H1 decreases, the second control valve 16 will open automatically and hydraulic fluid will flow to the pressure amplifier unit which will deliver pressure again until the desired pressure is reached at the high pressure port H1 and then the second control valve 16 will close again. To this end it is of advantage to use a second control valve 16 in which the first control port 17 has a larger pressure area than the second control port 18. However, in this case the ratio between the area of the first control part 17 and of the second control part 18 is somewhat smaller than the amplification factor.

Figure 2:
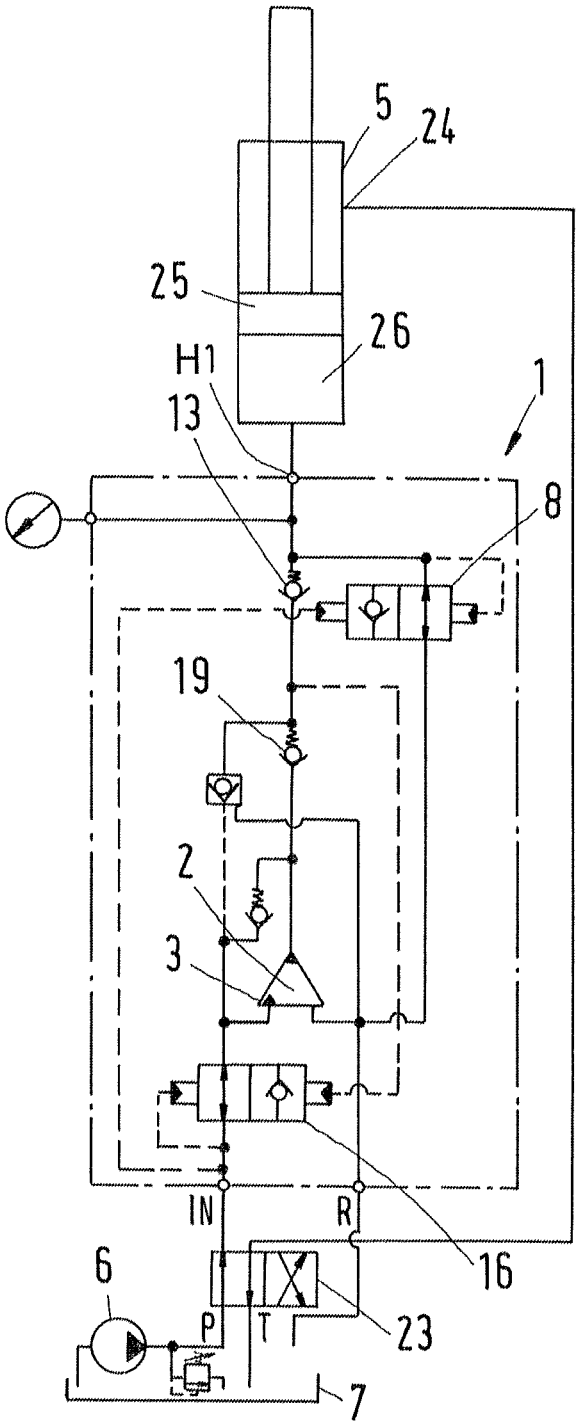
FIG. 2 shows a second embodiment of the pressure amplifier arrangement, FIG. 3 schematically shows the arrangement of several components within a housing, FIG. 4 schematically shows other components of the pressure amplifier arrangement in the housing.

FIG. 2 shows a second embodiment in which the pressure amplifier arrangement 1 is the same as in FIG. 1. However, the hydraulic actuator is a double acting cylinder. A switching valve 23 is arranged between the pump 6, the supply port IN and the return port R. In the condition shown in FIG. 2 the pump pressure is delivered to the amplifier unit 2 so that the high pressure port H1 receives hydraulic fluid under the amplified pressure. The return port R is connected to the tank 7.

When the switch valve 23 is switched into the other position, the supply port IN is connected to tank 7, so that the pressure at the low pressure input 3 of the pressure amplifier unit 2 is decreased. As explained above, this leads to a situation, in which the first control valve 8 is switched to the open condition in which the high pressure port H1 is connected to the return port R. At the same time the hydraulic consumer 5 is supplied with pressure at another port 24 loading a piston 25 of the consumer 5 in the other direction. Hydraulic fluid displaced from a pressure chamber 26 of the hydraulic consumer 5 can flow directly to the return port R.

Figure 3:
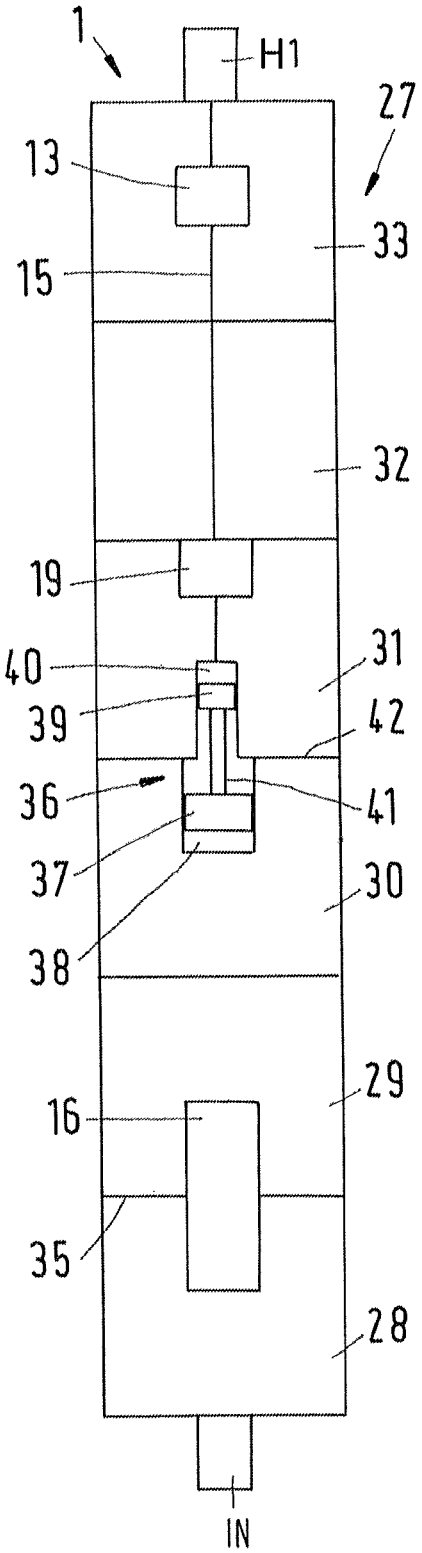
Figure 4:
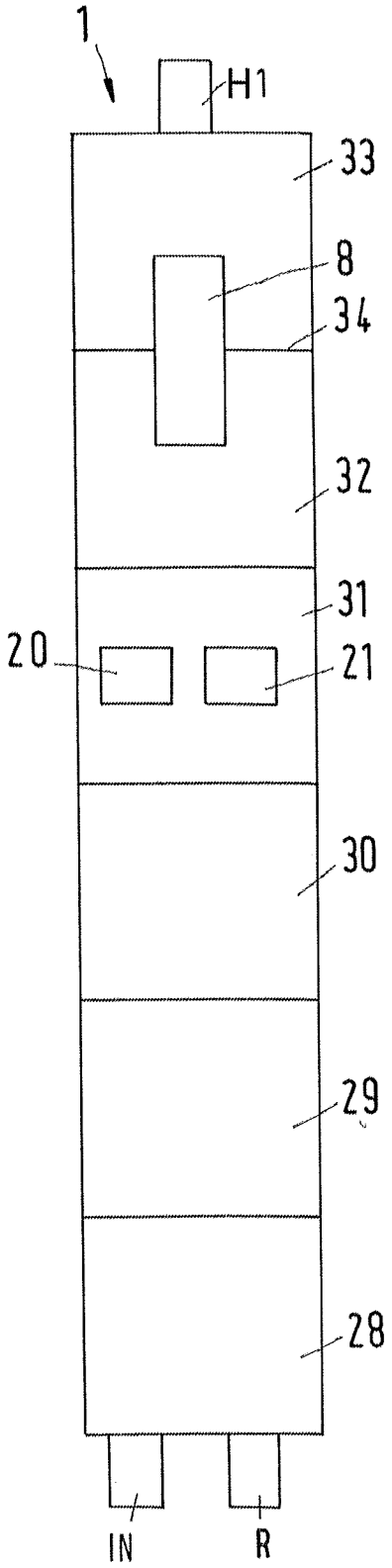

FIG. 3 shows schematically some components of the hydraulic pressure amplifier arrangement and FIG. 4 shows some other components. The views in FIG. 3 and FIG. 4 are from different directions, which are, for example, angularly spaced by 90° from each other.

The pressure amplifier arrangement comprises a housing 27 which comprises a number of blocks 28-33 which form a stack. The number of blocks can be larger than 6. The blocks 28-33 are connected to each other by means of bolts or screws.

The first control valve 8 bridges an interface 34 between two adjacent housing blocks 32, 33. The second control valve 16 bridges an interface 35 between two adjacent housing blocks 28, 29. The pressure amplifier unit 2 comprises a differential piston 36. The differential piston 36 comprises a low pressure piston 37 arranged in a low pressure cylinder 38 and a high pressure piston 39 arranged in a high pressure cylinder 40. The low pressure piston 37 and the high pressure piston 39 are connected by means of a piston rod 41. Thus, the low pressure piston 37 and the high pressure piston 39 can be moved together at least during an amplification stroke. The amplification piston 36 bridges likewise an interface 42 between two adjacent blocks 30, 31.

The first check valve 13 and the second check valve 19 are separated by the housing block 32. As mentioned above, the housing block 32 accommodates part of the first control valve 8.

Furthermore, the differential piston 36 has a direction of movement. The first control valve 8 comprises a first control valve element (not shown). The second control valve 16 comprises a second control valve element (not shown). The two control valve elements are movable in the same direction as the differential piston 36.

Figure 5:
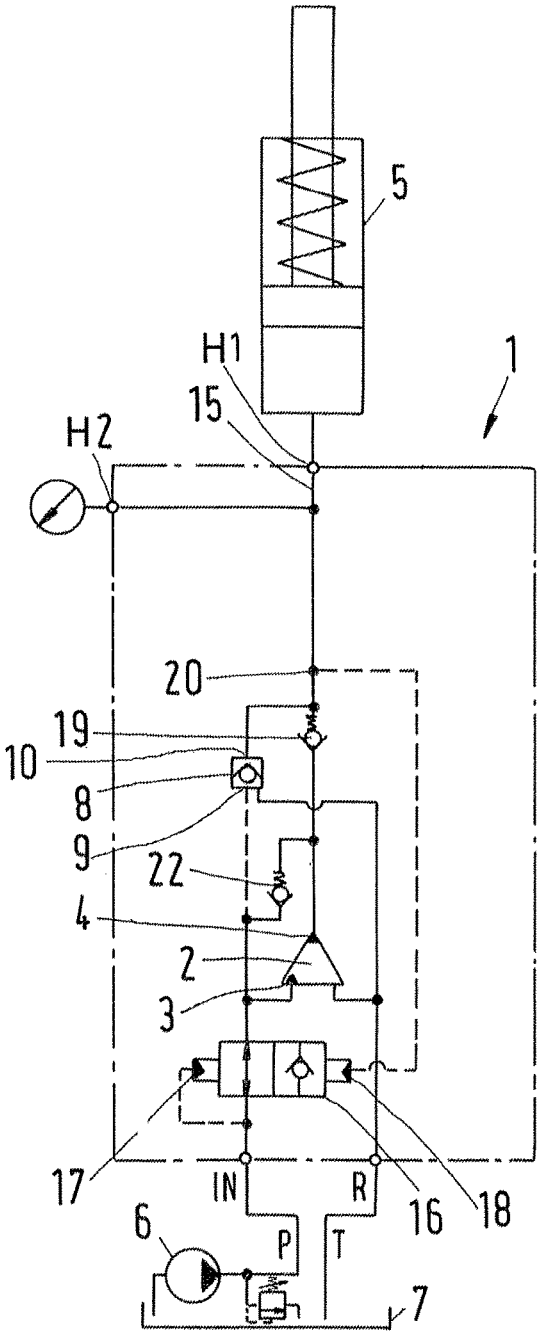
FIG. 5 shows a third embodiment of a hydraulic pressure amplifier arrangement.

FIG. 5 shows a third embodiment of the pressure amplifier arrangement the function of which corresponds basically to the first embodiment illustrated in FIG. 1. However, the third embodiment is simplified.

The dump valve 21 and the first check valve 13 are omitted. The first control valve 8 replaces the dump valve 21. The first control valve 8 is shown in form of a kind of check valve opening in a direction away from the high pressure port H1. The first control pressure area 9 is connected to the supply port IN via the second control valve 16. The second control pressure area 10 is connected to the high pressure port H1. Again, the first control pressure area 9 is larger than the second control pressure area 10, at least by a factor corresponding to the amplification factor, so that the first control valve 8 is held in a closed condition as long as there is a pressure at the supply port IN.

Figure 6:
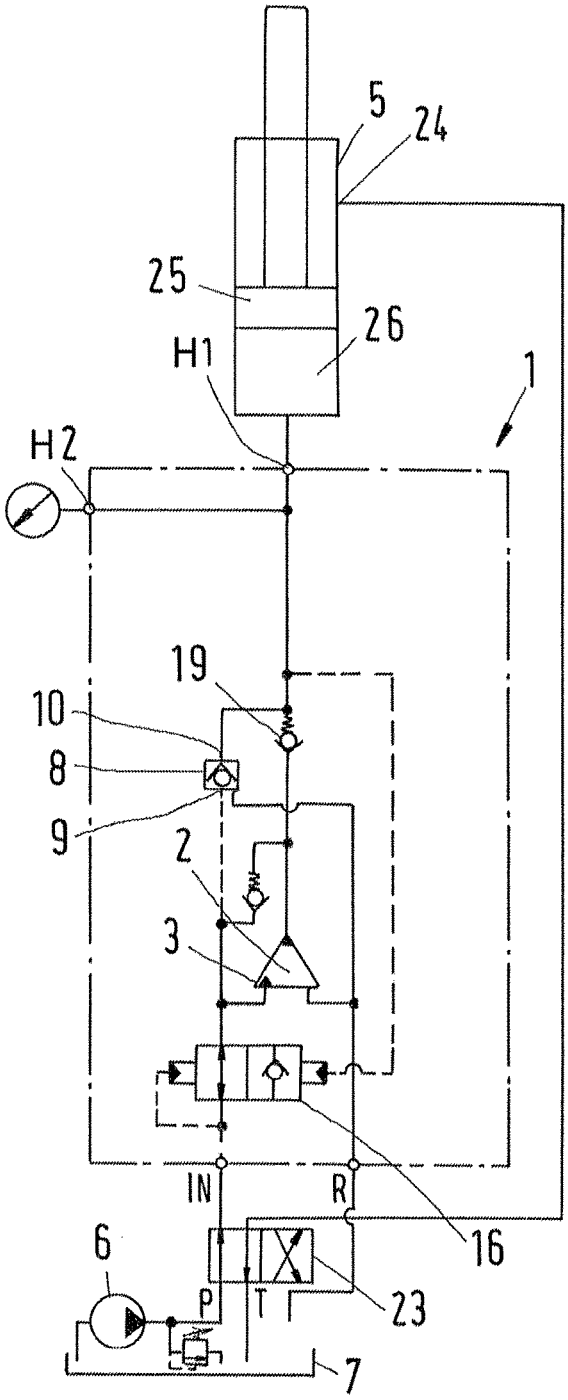
FIG. 6 shows a fourth embodiment of a hydraulic pressure amplifier arrangement, and FIG. 7 schematically shows the arrangement of several components within a housing of the third embodiment.

FIG. 6 shows a fourth embodiment of a pressure amplifier arrangement which is basically the same pressure amplifier arrangement as FIG. 5, however, in connection with a double acting cylinder 5.

Figure 7:
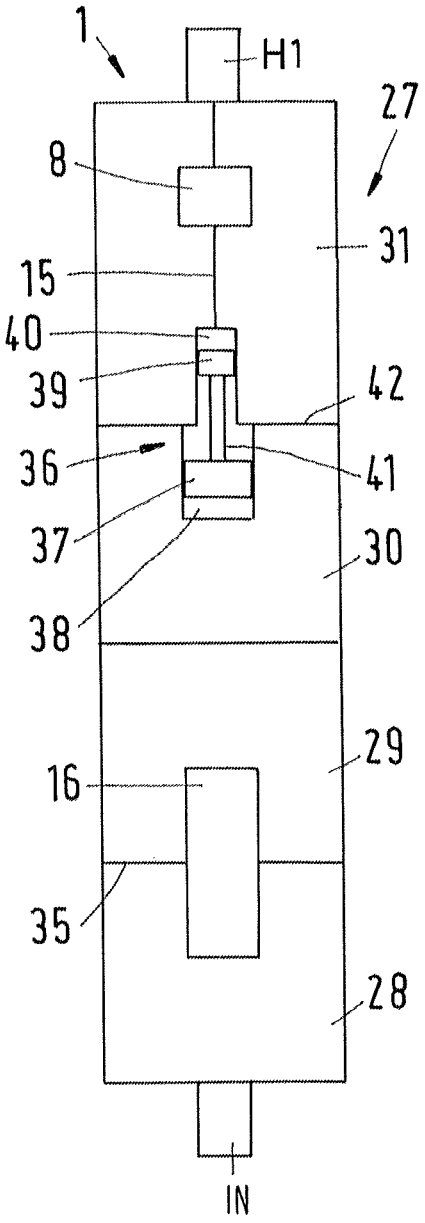

Since in the embodiments of FIGS. 5 and 6 two valves, i. e. the dump valve 21 and the first check valve 13 of FIG. 1, are no longer necessary, the number of blocks can be reduced. As it comes out from FIG. 7, only four blocks 28, 29, 30, and 31 are needed.

The first control valve 8 can have a valve element in form of a ball which is pressed against a valve seat by the pressure acting on the second control pressure area 10 to close the first control valve 8 and to hold it in closed condition. To open the first control valve 8, the ball can be pushed away from the valve seat by a pin connected to a piston which forms the first control pressure area 9. The diameter of the piston can be made much larger than the diameter of the ball.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic pressure amplifier arrangement comprising a supply port, a return port, a high pressure port, and a pressure amplifier unit having a low pressure inlet connected to the supply port and a high pressure outlet connected to the high pressure port, wherein the pressure amplifier unit comprises an amplification factor, wherein a control valve is arranged in a connection between the high pressure port and the return port, wherein the control valve is controlled by a pressure difference between the high pressure port and the supply port.

2. The hydraulic pressure amplifier arrangement according to claim 1, wherein the control valve comprises a first control pressure area connected to the supply port and a second control pressure area connected to the high pressure port, wherein a pressure acting on the first pressure area loads the control valve in a closing direction and a pressure acting on the second pressure area loads the control valve in an opening direction, wherein a ratio between the first control pressure area and the second control pressure area is larger than the amplification factor.

3. The hydraulic pressure amplifier arrangement according to claim 2, wherein the control valve comprises a check valve interrupting, in a closed condition of the control valve, the connection between the high pressure port and the return port.

4. The hydraulic pressure amplifier arrangement according to claim 2, wherein a second control valve is arranged between the supply port and the pressure amplifier unit, wherein the second control valve is operable to interrupt a connection between the supply port and the pressure amplifier unit.

5. The hydraulic pressure amplifier arrangement according to claim 1, wherein the control valve comprises a check valve interrupting, in a closed condition of the control valve, the connection between the high pressure port and the return port.

6. The hydraulic pressure amplifier arrangement according to claim 5, wherein a second control valve is arranged between the supply port and the pressure amplifier unit, wherein the second control valve is operable to interrupt a connection between the supply port and the pressure amplifier unit.

7. The hydraulic pressure amplifier arrangement according to claim 1, wherein a second control valve is arranged between the supply port and the pressure amplifier unit, wherein the second control valve is operable to interrupt a connection between the supply port and the pressure amplifier unit.

8. The hydraulic pressure amplifier arrangement according to claim 7, wherein the second control valve is controlled by a difference between a pressure at the supply port acting on a first control port of the second control valve and a pressure in a line from the high pressure outlet to the high pressure port acting on a second control port of the second control valve, wherein the second control port is separated from a second pressure control area by means of a first check valve opening in a direction towards the second pressure control area, and wherein the control valve comprises the second pressure control area connected to the high pressure port and a pressure acting on the second pressure control area loads the control valve in an opening direction.

9. The hydraulic pressure amplifier arrangement according to claim 8, wherein the first check valve is arranged between the high pressure outlet and the high pressure port.

10. The hydraulic pressure amplifier arrangement according to claim 9, wherein a second check valve is arranged between the high pressure outlet and the high pressure port upstream a connection to the second control port.

11. The hydraulic pressure amplifier arrangement according to claim 10, wherein the pressure amplifier unit, the first control valve, the second control valve, the first check valve, and the second check valve are arranged in a common housing.

12. The hydraulic pressure amplifier arrangement according to claim 11, wherein the housing comprises four or six housing blocks in the form of a stack.

13. The hydraulic pressure amplifier arrangement according to claim 11, wherein the first control valve and/or the second control valve are bridging an interface between two adjacent housing blocks.

14. The hydraulic pressure amplifier arrangement according to claim 11, wherein the common housing comprises a plurality of housing blocks, wherein the pressure amplifier unit comprises a low pressure piston arranged in one housing block and a high pressure piston arranged in another housing block adjacent to the one housing block.

15. The hydraulic pressure amplifier arrangement according to claim 11, wherein the common housing comprises a plurality of housing blocks, wherein the first check valve and the second check valve are separated by one of the housing blocks which accommodates part of the first control valve.

16. The hydraulic pressure amplifier arrangement according to claim 11, wherein the first control valve comprises a first control valve element and the second control valve comprises a second control valve element, wherein movable parts of the pressure amplifier unit have the same direction of movement as the first control valve element and the second control valve element.

* * * * *